US005164056A

United States Patent [19]

Loeck

[11] Patent Number: 5,164,056

[45] Date of Patent: Nov. 17, 1992

[54] APPARATUS AND PROCESS FOR THE ANODIC OR CATHODIC ELECTROCOATING OF HOLLOW BODIES, IN PARTICULAR OF CANS

[75] Inventor: Karsten Loeck, Berlin, Fed. Rep. of Germany

[73] Assignee: PLM Berlin Dosenwerk GmbH, Berlin, Fed. Rep. of Germany

[21] Appl. No.: 614,826

[22] Filed: Nov. 16, 1990

[30] Foreign Application Priority Data

| | | | |
|---|---|---|---|
| Nov. 16, 1989 | [DE] | Fed. Rep. of Germany | 3938363 |
| Feb. 22, 1990 | [DE] | Fed. Rep. of Germany | 4005619 |
| Feb. 22, 1990 | [DE] | Fed. Rep. of Germany | 4005620 |
| Feb. 22, 1990 | [DE] | Fed. Rep. of Germany | 4005622 |

[51] Int. Cl.[5] ..... C25D 13/00

[52] U.S. Cl. ..... 204/180.2; 204/180.7; 204/299 EC; 204/300 EC

[58] Field of Search ..... 204/180.2, 180.7, 299 EC, 204/300 EC

[56] References Cited

U.S. PATENT DOCUMENTS

| | | | |
|---|---|---|---|
| 3,922,213 | 11/1975 | Smith et al. | 204/180.7 |
| 4,400,251 | 8/1983 | Heffner et al. | 204/299 EC |
| 4,529,492 | 7/1985 | Buchholz et al. | 204/180.7 |

*Primary Examiner*—John Niebling
*Assistant Examiner*—David G. Ryser
*Attorney, Agent, or Firm*—Nils H. Ljungman and Associates

[57] ABSTRACT

An apparatus and process for the anodic or cathodic electrocoating of hollow bodies, in particular of cans, such as beverage cans, by means of a water-soluble lacquer as an electrolyte liquid, which is in contact with the cathode or anode and is sprayed in at least one uninterrupted stream which produces a conductive connection, onto the surfaces of the hollow body which forms the anode or cathode.

20 Claims, 6 Drawing Sheets

APPARATUS AND PROCESS FOR THE ANODIC OR CATHODIC ELECTROCOATING OF HOLLOW BODIES, IN PARTICULAR OF CANS

BACKGROUND OF THE INVENTION

1. Field of the Invention

This invention relates to a process and apparatus for the anodic or cathodic electrocoating of hollow bodies, in particular of cans, such as beverage cans, by means of a water-soluble lacquer as an electrolyte liquid, which is in contact with the cathode or anode and is sprayed in at least one uninterrupted stream, which produces a conductive connection, onto the surfaces of the hollow body which forms the anode or cathode.

2. Background Information

The art includes processes of this type as well as devices for the performance of such processes. In the art, the electrophoretic application of the coating material is performed using spraying, dipping or flooding methods. The apparatus required for such processes is relatively complex and expensive to create the required uninterrupted conductive connection between the lacquer and the material surface to be coated with the lacquer (See, for example, German Patent Publication Published for Opposition Purposes No. 26 33 179 and German Laid Open Patent Appln. No. 25 48 414.) In such coating processes, it is also considered disadvantageous that the coating time for each item is quite long, which means that in a manufacturing line, e.g. for beverage cans, a can production machine must be followed by several coating devices operating in parallel and simultaneously.

OBJECT OF THE INVENTION

One object of the invention is a process of the type described above, which makes it possible to perform the anodic or cathodic electrocoating of hollow bodies, in particular of cans, in higher numbers per unit of time, and which does not require a technically complex or expensive coating apparatus.

This and other objects are accomplished by the invention, in that the hollow bodies to be coated are pushed with the opening downward across an electrically conductive grid or grate. The lacquer is sprayed through the open spaces between the bars of the grid or grate in ascending streams into or over the hollow body, and thus the entire inner and outer surface of the hollow body is covered with a continuous layer.

The further configuration, or further aspects of the process are described in detail below.

An apparatus for the performance of the process for a preferably anodic electrocoating is characterized by the following features:

a) a grate supporting the hollow body to be lacquered, wherein the grate together with the hollow body forms at lest one of the anode and the cathode, preferably the anode;

b) a housing located underneath the grid and forming the other of the anode and the cathode, preferably the cathode, with nozzle tubes located on top of the housing, wherein the tubes discharge in the space between the grid bars and in the vicinity of the upper edge;

c) a catch basin, underneath the housing and the grid, and which is a component of a lacquer circuit which runs through the housing and the nozzle tubes, which circuit includes a circulation pump, a filter, and, possibly, a cooler and a reservoir. In other words, a lacquer circuit or lacquer circulation configuration utilized by the present invention is preferably provided via the housing, nozzle tubes and catch basin. In addition, the circuit preferably includes a circulation pump, a filter, and, possibly, a cooler and a reservoir.

An apparatus for the performance of the process for cathodic electrocoating corresponds substantially to an apparatus for the performance of the process according to the invention for anodic electrocoating, but in addition to the characteristics of the cathodic electrocoating system, it has a dialysis circuit which runs through the housing. In that case, the housing is divided by a membrane into an upper inner chamber and a lower inner chamber, whereby the upper inner chamber is in communication with the nozzle tubes and with at least one lacquer feeder line, and the lower inner chamber contains an electrode with a large surface area forming the anode, and wherein the lower inner chamber is also connected via an anolyte feed line and an anolyte discharge line to the dialysis circuit.

Additional characteristics of the apparatus, which relate both to the apparatus for anodic electrocoating and to the apparatus for cathodic electrocoating, are disclosed further below.

Some of the advantages achieved with the invention consist particularly of the fact that the process using the apparatus according to the invention makes possible an extraordinarily rapid and economical electrocoating of hollow bodies. Practical tests have shown that the process leads to a significant saving of lacquer (approximately 30–40%). At the same time, there is a lower consumption of solvent, and a saving of energy, in particular a saving of the thermal energy required for the drying. The process therefore combines major economic benefits and reduced pollution.

BRIEF DESCRIPTION OF THE DRAWINGS

Embodiments of an apparatus for the performance of the process described above are illustrated in the accompanying drawings, with the process explained in greater detail further below.

DESCRIPTION OF THE PREFERRED EMBODIMENTS

Figure 1:
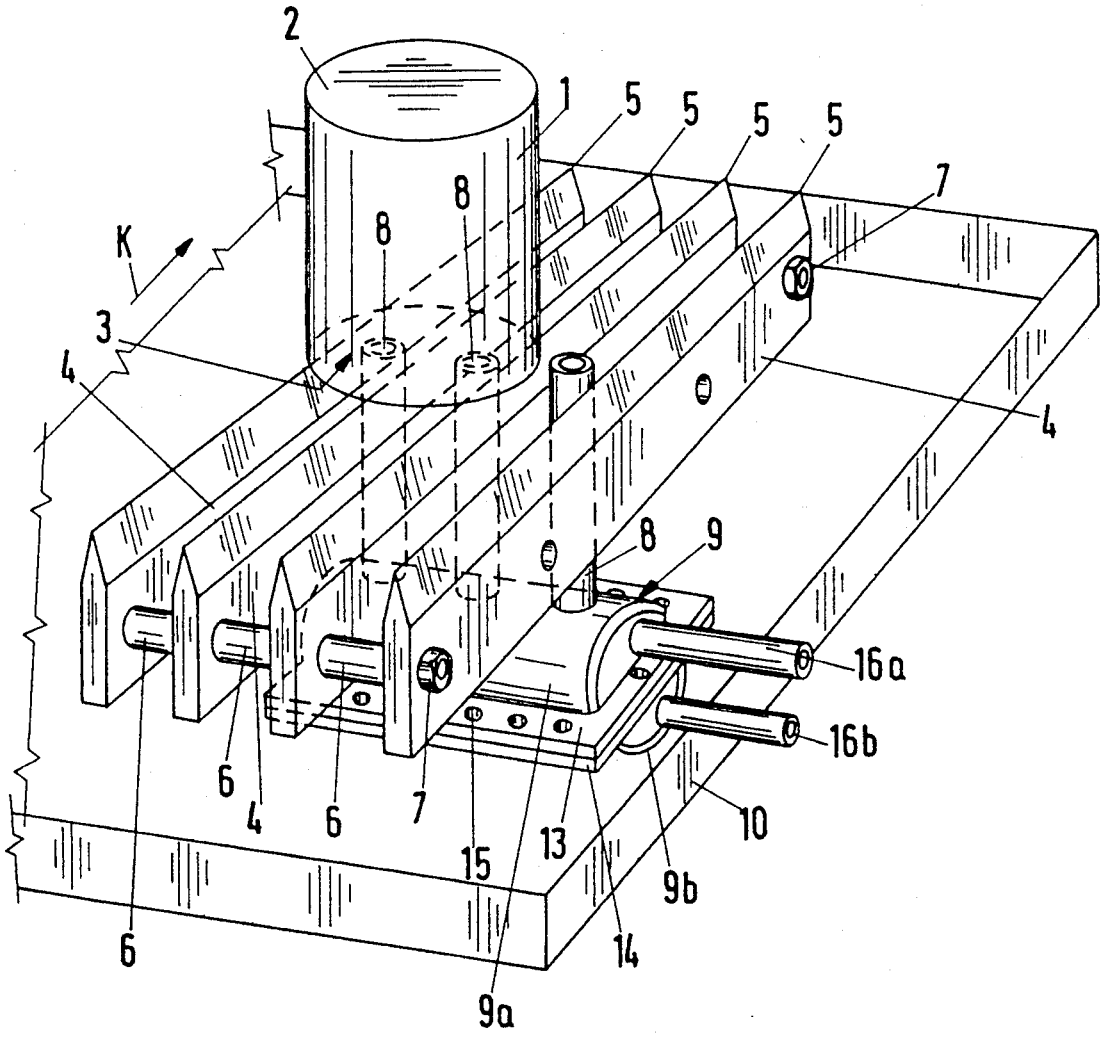
FIG. 1 is a perspective view of a coating apparatus which is part of a unit for preferably anodic electrocoating.

As shown in FIG. 1, a hollow metal body 1, here shown as a beverage can, is placed on the grid bars 4 with the bottom 2 oriented substantially upwards and the opening 3 oriented substantially downwards. The grid bars 4 are arranged on edge next to one another and parallel to one another with some distance or spacing in between, and are held in place by means of spacers 6 and threaded rods with nuts 7. The tops 5 of the grid bars 4 supporting the hollow body 1 are designed as blades, so that there is practically a point contact between the edge of the opening 3 of the hollow body 1 and the grid bars 4, thereby guaranteeing a very good electrical contact. The hollow bodies 1, only one of which is shown here for purposes of simplification, are pushed along on the blade-like tops 5 of the grid bars 4 in the direction of the arrow K, so that any adhering traces of lacquer on the rims of the hollow bodies are constantly scraped off, and thus there is always metallic contact between the edge of the opening 3 of the hollow body 1 and the grid bars 4. Together with the hollow bodies 1, the grid bars 4 form and electrode, preferably an anode. A housing 9, which forms the other electrode, preferably the cathode, and is located underneath the grid bars 4, has several nozzle tubes 8, preferably three to five in number, oriented substantially perpendicular to the grid bars 4. These nozzle tubes 8 discharge in the space between the grid bars 4 and in the vicinity of the upper edge of the tops 5 of the grid bars 4. Below the grid bars 4 and the housing 9 there is a catch basin 10, which is a component of a lacquer circuit. The lacquer circuit is propelled through the housing 9 and the nozzle tubes 8 by means well known in the art and therefore not described here in any additional detail. The circuit may additionally be provided with a circulation pump, a filter, and, possibly, a cooler and a reservoir.

The nozzle tubes 8 preferably include insulating material. Additionally, the streams of lacquer being discharged from the nozzle tubes 8 preferably have a discharge pressure of less than 1 bar, or 0.1 MPa.

Figure 2:
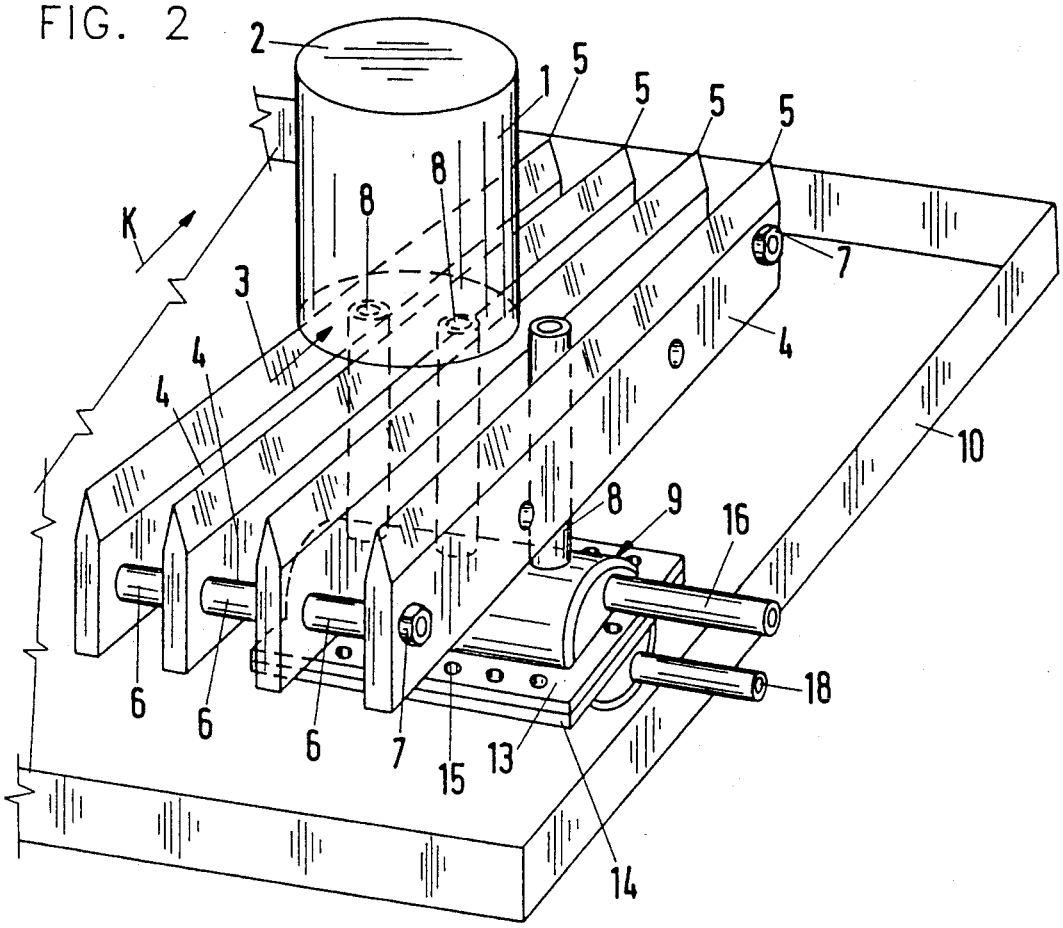
FIG. 2 is substantially the same view as FIG. 1, showing an apparatus for preferably cathodic electrocoating.

FIGS. 1 and 2 may be considered to be drawn on a scale of between about 1/6 and about ½ of the actual size of the apparatus. Therefore, the hollow body 1 which undergoes the coating process may be preferably between about 2 and 6 inches in diameter. Each of the grid bars 4 preferably has a width, at the base, of ½ to 1½ inches and a height, as measured from the base of the bar to the tip of the blade, of about 2 to 6 inches. The sides of the blade at the top 5 of each grid bar 4 may preferably define an angle between 15 and 35 degrees. Additionally, the spacers 6 preferably have a diameter of between ½ and 1½ inches and the spacing between each of the grid bars 4 is preferably in the range of 1 to 3 inches. Each of the nozzle tubes 8 preferably has a height of between 3 and 9 inches and a diameter of between ¼ and ¾ inches. The catch basin 10 preferably has a side horizontal dimension, such as for the side shown in the right-hand portion of FIGS. 1 and 2, of about 10 to 30 inches.

The housing 9 consists of an upper part **9*a* which has a flange 13 and a lower part 9*b* which has a flange 14. The flanges 13 and 14 are connected together by means of screws (not shown) inserted in holes 15 through the flanges 13 and 14**.

The substantially semicircular cross-section of each of the upper part **9*a* and the lower part 9*b* of housing 9 preferably includes a wall thickness of about 3/32 to 9/32 inches and an outer radius, as measured from a substantially central point of the semicircle to the exterior surface of the housing, of about ⅞ to 2⅝ inches. Additionally, each of the flanges 13 and 14 preferably has a thickness, or vertical dimension, of about ⅛ to ⅜ inches. It may also be seen that the semicircular portions of the housing 9 preferably have a horizontal dimension, which dimension is oriented substantially transversely to the orientation of the grid bars 4 thereabove, of about 3¾ to 11¼ inches. The flanges 13 and 14 preferably have a horizontal dimension, substantially transverse to the orientation of the grid bars 4, of about 4½ to 13½ inches and another horizontal dimension, substantially parallel to the orientation of the grid bars 4**, of about 2 7/16 to 7 5/16 inches.

The housing 9 is in communication with the nozzle tubes 8 and an electrolyte feed line **16*a*. There is also an electrolyte return line 16*b*, so that circulation in the circuit is possible for excess lacquer and/or electrolyte liquid not discharged from the nozzle tubes 8. The electrolyte feed line 16*a* preferably has a diameter of between ⅜ and 1⅛ inches and the electrolyte return line 16*b*** preferably has a diameter of between 5/16 and 5/16 inches.

Inside the housing 9, there is provided an electrode (not shown) which has a large surface area, and which makes the housing 9 preferably act as the cathode, and is connected to the appropriate pole of a direct current source. The grid bars 4 are correspondingly connected to the other pole of this direct current source.

Figure 3:
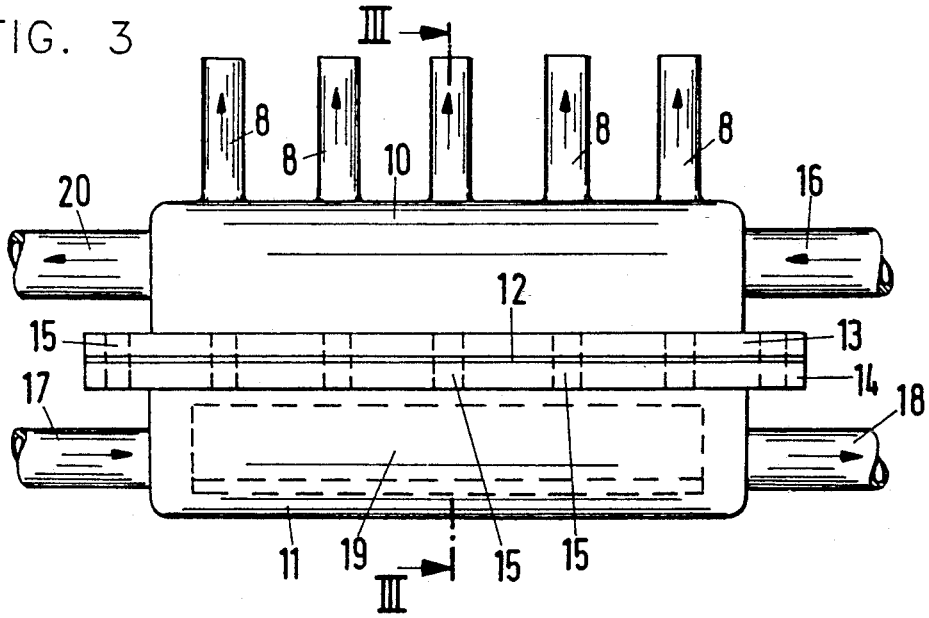
FIG. 3 is an enlarged side view of a detail from FIG. 2.
Figure 4:
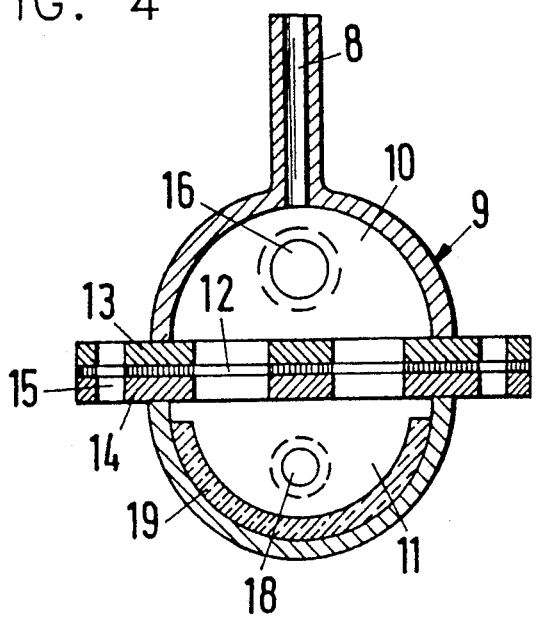
FIG. 4 is a cross-section taken along Line III in FIG. 3.

The apparatus illustrated in FIG. 2 corresponds substantially to the apparatus illustrated in FIG. 1, so that the same parts are labelled with substantially the same reference numbers in both figures. Since the apparatus shown in FIG. 2 is intended for the performance of the cathodic electrocoating process, it has a dialysis circuit running through the housing 9. For the purpose of cathodic electrocoating, as shown in FIGS. 3 and 4, there is a membrane 12 in the housing 9 between flanges 13 and 14. The membrane 12 divides the housing 9 into an upper inner chamber 10 and a lower inner chamber 11. FIGS. 3 and 4 may be considered to be drawn on a scale between about ⅓ of the actual size of the apparatus and about the full actual size of the apparatus. The upper inner chamber 10 is in communication with the nozzle tubes 8, and with a lacquer feed line 16 and a lacquer return line 20, while the lower inner chamber 12 has an anolyte feed line 17 and an anolyte discharge line 18. These anolyte feed and discharge lines 17, 18 are connected to a dialysis circuit, which is used to remove the acid residues formed on the anode. The lacquer feed line 16 and the lacquer return line 20 each have a diameter of about ⅛ to 1⅜ inches and the anolyte feed line 17 and anolyte discharge line 18 each preferably have a diameter of between 5/16 and 15/16 inches.

In the lower inner chamber 11, there is an electrode 19 which has a large surface area and which is electrically connected, in a manner not shown, to the positive pole of a direct current source. The grid bars 4 are correspondingly connected to the negative pole of this direct current source (not shown). The electrode 19, which is preferably disposed on a substantial portion of the interior semicylindrical surface of the lower inner chamber **9*b*, may have a length of about 3¼ to 9¾ inches and a thickness of about ⅛ to ⅜ inches. In a circumferential direction, the electrode 19 may be disposed over the entire circumferential dimension of the above-mentioned semicylindrical surface, minus ⅛ to ⅜ inches of circumferential distance, as shown, on each side of the semicylindrical surface, directly adjacent to the flange 14**.

Figure 5:
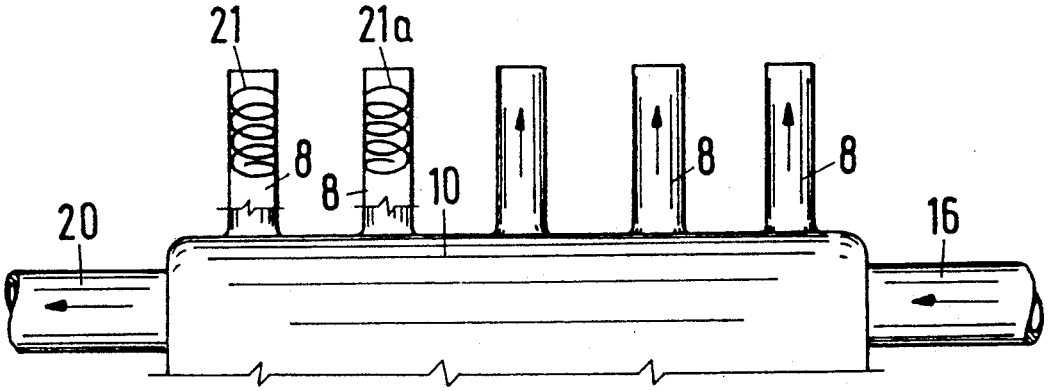
FIG. 5 is a partial cross-sectional view of FIG. 3.

Referring now to FIG. 5, which may be considered to be drawn on essentially the same scale as FIG. 3, the partial illustration of the housing 9 depicted therein shows that a cylindrical coil spring or helix 21 or 21*a* is inserted in each of the nozzle tubes 8. Preferably, adjacent nozzle tubes 8 are alternately provided with a right-hand twist and a left-hand twist spring or helix. By means of these springs or helices, the lacquer streams ascending from the nozzle tubes 8 are rotated around their own axis. Practical tests have shown that an extraordinarily good filling of the inside of the hollow body can be achieved if the hollow body 1, pushed above the grid bars, spans at least three bars, i.e., if the inside of the hollow body is contacted by at least two lacquer streams rotating in opposite directions. Each of the coil springs or helices 21 and 21*a* is preferably ½ inch or more in total length, from top to bottom, and preferably has a pitch of about 1/16 to 3/16 inches.

Figure 6:
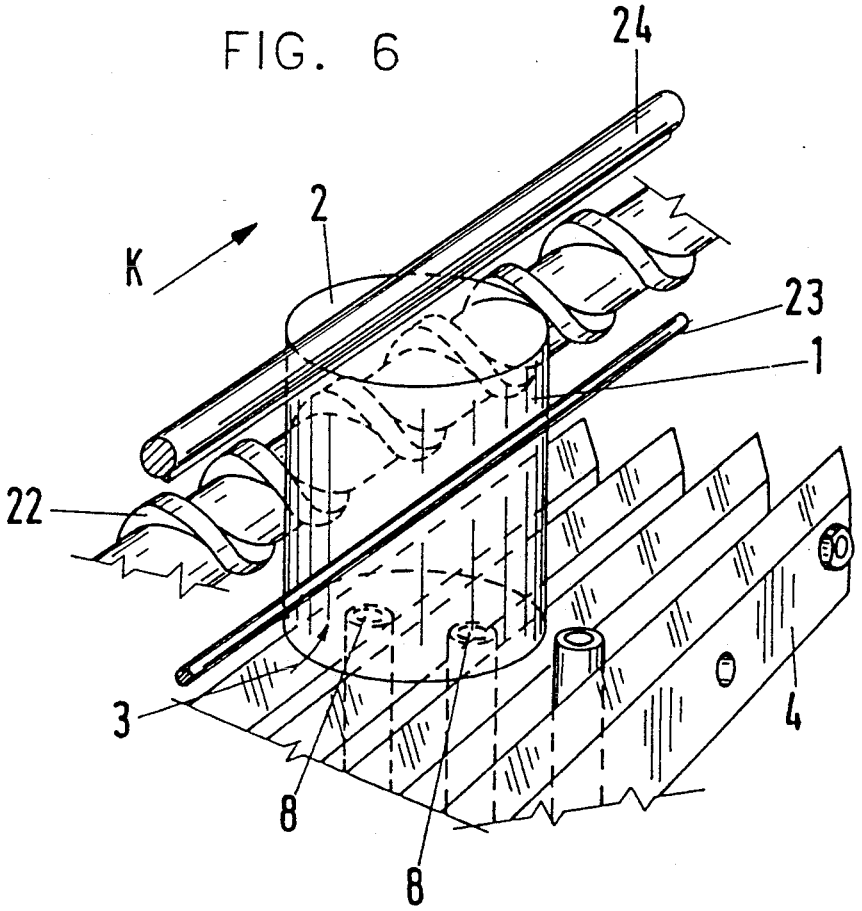
FIG. 6 is a portion of FIG. 1 and/or FIG. 2, in which the means used to move and guide the hollow bodies is shown.

FIG. 6, which is drawn essentially on the same scale as FIGS. 1 and 2, shows, in a partial sectional view, the arrangement of an apparatus used to push and guide the hollow bodies 1. Here again, for reasons of simplicity, only one hollow body 1 is shown. The hollow body 1 is pushed across the grid bars 4 by a screw conveyor 22 in the direction of the arrow K with the opening 3 facing substantially downwards, whereby a guide strip 23 guides the hollow body 1 on the side facing away from the screw conveyor 22. Provided adjacent the hollow body 1, there is a hold-down or retention strip 24, which ensures that the hollow body 1 does not lift up off of the grid bars 4 as a result of the ascending lacquer streams. During the passage of the hollow body 1 across the grid bars 4, the outside surface of the hollow body 1 is also preferably flooded and coated by the lacquer being discharged from the nozzle tubes 8.

The hollow bodies 1 may be moved across the grid bars 4 in a stepwise fashion or in a continuous fashion. That is, to enable lacquer coating of the hollow body 1, the hollow bodies may be caused to stop substantially directly above the nozzles 8 or may move continuously past the nozzles 8 while the process of lacquer coating is taking place. Preferably, the filling time for the lacquer coating of each hollow body 1, or what may be regarded as the time required to substantially coat the hollow body 1 with lacquer, may be approximately 15 to 20 milliseconds. The hold-down or retention strip 24 preferably has a diameter of between 3/16 and 9/16 inches. The screw conveyor 22 preferably has a diameter of between ½ and 1½ inches and a pitch of between ½ and 1½ inches.

Figure 7:
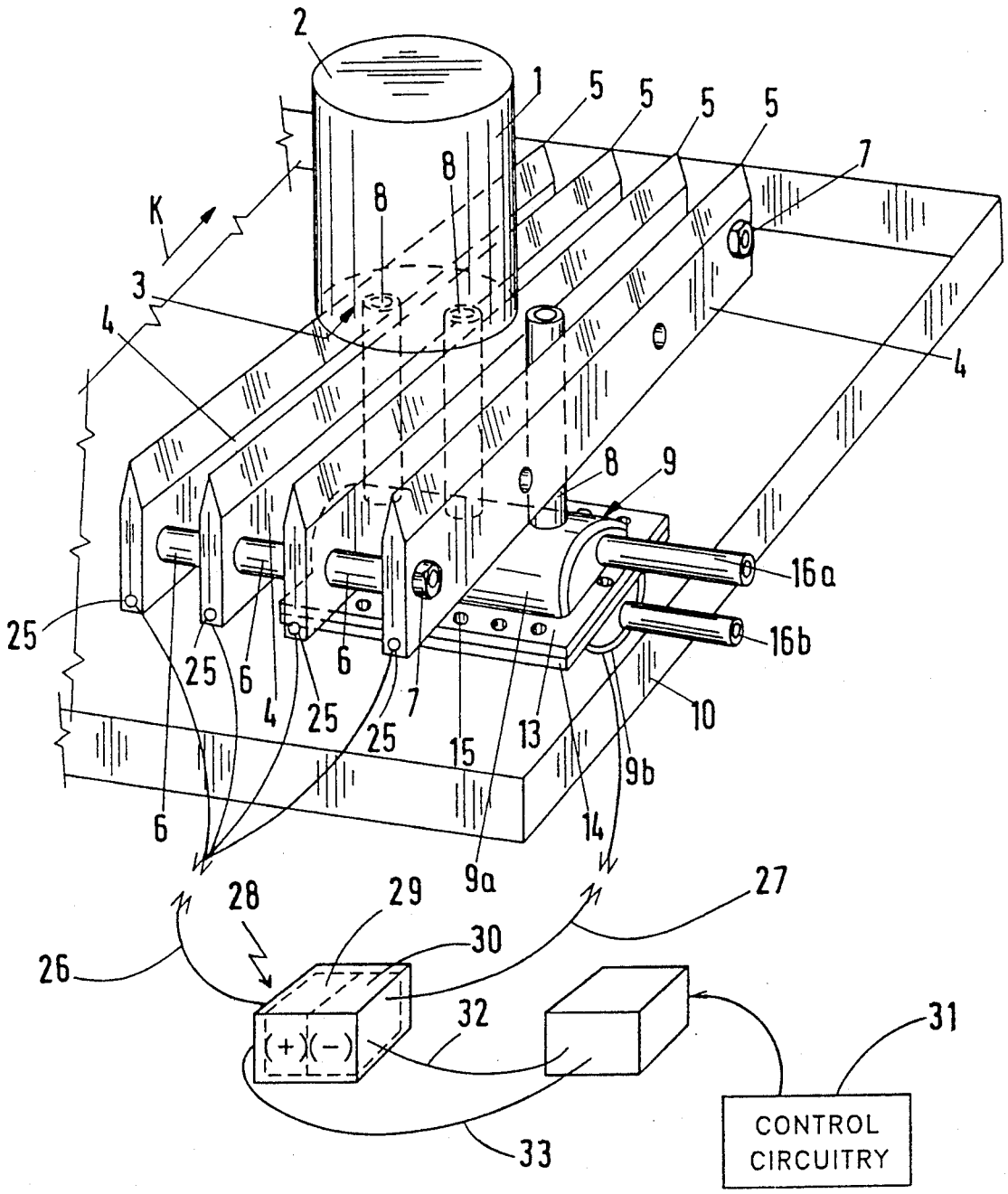
FIG. 7 is substantially the same view as FIG. 1, but additionally showing a power supply and connections therefrom to the coating apparatus.

FIG. 7 is substantially the same view as FIG. 1, showing a preferable arrangement for electrically charging the anodic and cathodic portions of the apparatus. Particularly, a set of connection points 25, one of each of which is preferably disposed on one end of each grid bar 4, may have originating therefrom an arrangement of wiring 26. Similarly, another wiring arrangement 27 may lead from a point on the housing 9. Both wiring arrangements 26 and 27 preferably lead to a direct current source 28. In the embodiment of FIG. 7, the grid bars 4 and hollow body 1 preferably act together as the anode and the electrode 19 (see FIG. 4) inside housing 9 preferably causes the housing 9 to act as the cathode. Therefore, wiring arrangement 26 preferably connects to one pole 29 of direct current source 28 while wiring arrangement 27 preferably connects to an opposite pole 30 of direct current source 28. It should be understood that such an arrangement for the provision of direct current to the apparatus may also be applied to the cathodic electrocoating embodiment of FIG. 2. Therefore, the charging of the poles 29 and 30, as shown in FIG. 7, of direct current source 28, should not be regarded as being necessarily representative of the actual charge associated with each of the anodic and cathodic components of the apparatus, but should primarily be taken to be substantially indicative of the fact that opposite charges are provided to each of the anodic and cathodic components of the apparatus.

The apparatus of the present invention also preferably includes an arrangement of control circuitry 31, as shown in FIG. 7. A pair of leads 32 and 33 electrically connect the control circuitry arrangement 31 with the direct current source 28. Preferably, one of the leads 32 connects to one pole 30 of the direct current source 28 and the other lead 33 preferably connects to the opposite pole 29 of the direct current source 28. Such a configuration enables the control circuitry arrangement 31 to control the type and degree of electrical charge to be directed from the direct current source 28 to the grid bars 4 and the electrode 19 of the housing 9.

Figure 8:
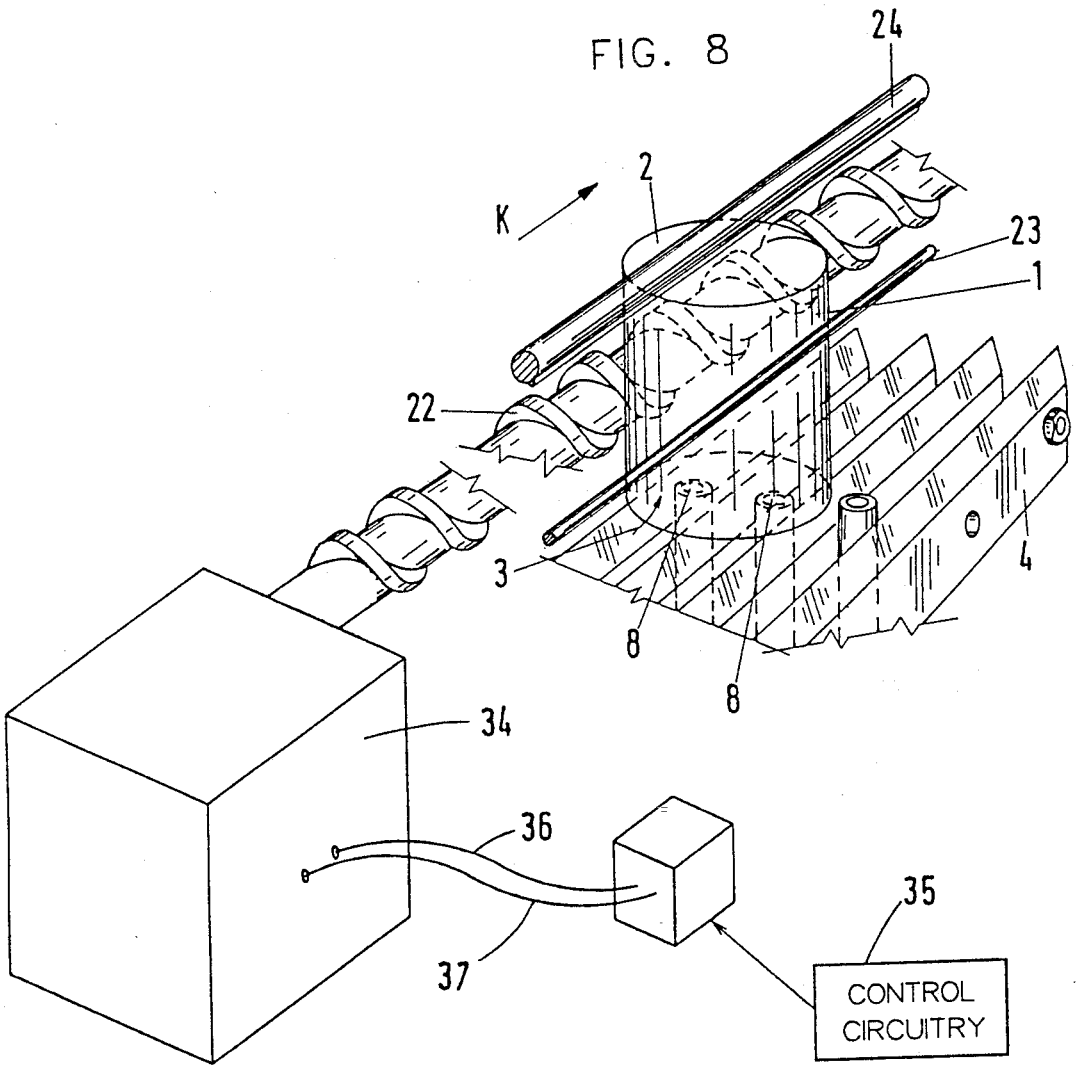
FIG. 8 is substantially the same view as FIG. 6, but additionally showing a device for propelling the means used to move the hollow bodies.

FIG. 8 is substantially the same view as FIG. 6, showing a preferable arrangement for affording movement of the hollow body 1 across the grid bars 4 in the direction marked by the arrow K. Screw conveyor 22 preferably originates at one end from a driving mechanism 34. The driving mechanism 34 may include a direct drive motor, in which the shaft of the screw conveyor 22 is preferably coaxially connected to and directly driven by a central shaft of the motor. However, other types of motors or driving mechanisms may be utilized to afford rotation of the shaft of the screw conveyor 22.

The screw conveyor driving mechanism 22 is preferably controlled by a control circuitry arrangement 35. A pair of leads 36 and 37 connect the control circuitry arrangement 35 with the driving mechanism 34 to preferably control the speed and direction of the motor or other driving device and to thereby control the rate at which the hollow body 1 is displaced in the direction indicated by arrow K along the grid bars 4.

The drawings generally show only a portion of a total installation, wherein a large number of hollow bodies are moved in the direction of the arrow K across grid bars 4, one after the other and next to one another with their openings down. The total installation is constructed in the manner of the known art and includes a conveyor installation, by means of which the hollow bodies to be coated are transported for cleaning, degreasing and the production of surface conversion coatings, through a rinsing zone, a dryer and finally, after coating, are once again transported through a rinsing zone and a dryer, as well as a lacquer bake oven.

In summary, one feature of the invention resides broadly in a process for the anodic or cathodic electrocoating of hollow bodies, in particular of cans, such as beverage cans, by means of a water-soluble lacquer as an electrolyte liquid, which is in contact with the cathode or anode and is sprayed in at least one uninterrupted stream, which produces a conductive connection, onto the surfaces of the hollow body which forms the anode or cathode, characterized by the fact that the hollow bodies are pushed with the opening downward across an electrically conductive grid or grate, whereby the lacquer is sprayed through the open spaces between the grid or grate bars in ascending streams into and/or over the hollow bodies, and the entire inside and outside surface of the hollow bodies is thereby coated with a continuous layer.

Another feature of the invention resides broadly in a process which is characterized by the fact that the hollow bodies are moved across the grate or grid stepwise or continuously.

Yet another feature of the invention resides broadly in a process which is characterized by the fact that the ascending lacquer streams rotate around their own axis.

A further feature of the invention resides broadly in a process which is characterized by the fact that adjacent lacquer streams rotate opposite to one another.

A yet further feature of the invention resides broadly in a process which is characterized by the fact that the lacquer streams have a discharge pressure of less than 1 bar (=0.1 MPa).

Yet another further feature of the invention resides broadly in a process which is characterized by the fact that for a brief period, the inside of the hollow bodies is completely filled by the ascending lacquer streams.

An additional feature of the invention resides broadly in a process which is characterized by the fact that the filling time is approximately 15–20 ms (milliseconds).

A yet additional feature of the invention resides broadly in a apparatus for the performance of the process for anodic electrocoating, characterized by the following features:

a) a grate 4 supporting the hollow body 1 to be lacquered, which together with the hollow body forms the anode, b) a housing 9 located underneath the grate 4 and forming the cathode, with nozzle tubes 8 located on top of the housing, which discharge in the space between the grid bars 4 and in the vicinity of the upper edge 5. p c) a catch basin 10, underneath the housing 9 and the grid 4, and which is a component of a lacquer circuit which runs through the housing 9 and the nozzle tubes 8, which in the manner of the prior art includes a circulation pump, a filter, possibly a cooler and a reservoir.

A further additional feature of the invention resides broadly in an apparatus which is characterized by the fact, that the housing 9 and the nozzle tubes 8 consist of insulating material, and the cathode is formed by an electrode having a large surface area and located in the housing 9.

A yet further additional feature of the invention resides broadly in an apparatus for the performance of the process for cathodic electrocoating, characterized by the following features:

a) a grate 4 supporting the hollow body 1 to be lacquered, which together with the hollow body forms the cathode, b) a housing 9 consisting of insulating material, located underneath the grate 4 and forming the anode, with nozzle tubes 8 located on top of the housing, which discharge in the space between the grid bars 4 and in the vicinity of the upper edge 5.

c) a catch basin 10, underneath the housing 9 and the grid 4, and which is a component of a lacquer circuit which runs through the housing 9 and the nozzle tubes 8, which in the manner of the prior art includes a circulation pump, a filter, possibly a cooler and a reservoir, and d) a dialysis circuit running through the housing 9.

A yet further additional feature of the invention resides broadly in an apparatus which is characterized by the fact that the housing 9 is divided by means of a membrane 12 into an upper inner chamber 10 and a lower inner chamber 11, whereby the upper inner chamber 10 is connected to the nozzle tubes 8 and to at least one lacquer feed line 16, and the lower inner chamber 11 contains an electrode 19 with a large surface area forming the anode, and is connected to the dialysis circuit by means of an anolyte feed line 17 and an anolyte discharge line 18.

Another further additional feature of the invention resides broadly in an apparatus which is characterized by the fact that the distance between the grid bars 4 is selected so that the hollow bodies 1 pushed across them are always in contact with at least three bars, i.e. the inside of the hollow body is contacted by at least two lacquer streams rotating in opposite directions.

A yet another additional feature of the invention resides broadly in an apparatus which is characterized by the fact that a cylindrical coil spring 21 or **21*a* is inserted in each of the nozzle tubes 8, whereby adjacent nozzle tubes 8** are equipped in alternation with a right-hand twist and a left-hand twist spring.

Another yet further feature of the invention resides broadly in an apparatus which is characterized by the fact that the top 5 of the grid bars 4 is shaped like a knife blade.

A still further feature of the invention resides broadly in an apparatus which is characterized by the fact that there is at least one screw conveyor 22 to move the hollow body 1.

A still further additional feature of the invention resides broadly in an apparatus which is characterized by the fact that on the side facing away from the screw conveyor, the hollow bodies 1 are guided 22 by a guide strip 23.

Another still further additional feature of the invention resides broadly in an apparatus which is characterized by the fact that there is at least one hold-down strip 24 above the hollow bodies 1 guided across the grid 4.

Examples of nozzles, which may be used with the embodiments of the present invention, may be found in U.S. Pat. No. 4,948,053, entitled "Paint spray nozzle"; U.S. Pat. No. 4,941,614, "Nozzle for spraying equipment"; U.S. Pat. No. 4,667,878, "Nozzle having a connected coaxial arrangement for a paint spraying device"; U.S. Pat. No. 4,269,355, "Self-cleaning spray nozzle"; and U.S. Pat. No. 4,220,286, "Adjustable spray tip".

Particularly, an example of a nozzle in which discharged liquid therefrom is caused to rotate, which nozzle may be used with the embodiments of the present invention, may be found in U.S. Pat. No. 4,558,822, entitled, "binary atomizing nozzle".

Examples of sheet-type electrodes, which may be used with the embodiments of the present invention, may be found in U.S. Pat. No. 4,900,895, entitled "Rectangular electrode"; and U.S. Pat. No. 4,505,723, "Filter apparatus".

Examples of water-soluble lacquers, which may be used with the embodiments of the present invention, may be found in U.S. Pat. No. 4,600,485, entitled, "Aqueous electrodip lacquer coating compound capable of being deposited at the cathode, and its use"; U.S. Pat. No. 4,554,212, entitled, "Heat curable aqueous lacquer coating composition, its use for electrical deposition, and a process of cathodic deposition onto an electrical conductive substrate"; and U.S. Pat. No. 4,259,219, "Water-dilutable lacquers and their use in baked coatings".

Examples of pumps, which may be used with the embodiments of the present invention, may be found in U.S. Pat. No. 4,895,499, entitled "Outlet valve assembly for paint sprayer"; U.S. Pat. No. 4,854,822, "Series impeller air pump for liquid sprayer"; U.S. Pat. No.

4,768,929, "High pressure paint pump"; and U.S. Pat. No. 4,768,932, "Hydraulic paint pump".

Examples of filters, which may be used with the embodiments of the present invention, may be found in U.S. Pat. No. 4,934,393, "Spray gun cleaning apparatus"; U.S. Pat. No. 4,894,073, "Filter"; U.S. Pat. No. 4,667,884, "Paint gun tip filter"; and U.S. Pat. No. 4,555,337, "Plug and filter assembly for paint sprayer".

Examples of coolers, which may be used with the embodiments of the present invention, may be found in U.S. Pat. No. 4,869,641, "Compressor"; and U.S. Pat. No. 4,780,056, "Turbo-compressor having air cooled bearing".

Examples of reservoirs, which may be used with the embodiments of the present invention, may be found in U.S. Pat. No. 4,932,589, "Method of and apparatus for electrical isolation of electrostatic sprayers", U.S. Pat. No. 4,884,752, "Electrostatic paint spray system with dual voltage isolating paint reservoirs"; and U.S. Pat. No. 4,638,949, "Device for spraying products, more especially, paints".

Examples of screw conveyors, which may be used with the embodiments of the present invention, may be found in U.S. Pat. No. 4,958,720, "Screw conveyor coupling apparatus; U.S. Pat. No. 4,911,558, "Screw conveyor"; U.S. Pat. No. 4,852,719, "Modular screw conveyor", U.S. Pat. No. 4,717,014, "Screw conveyor"; and U.S. Pat. No. 4,600,150, "Spraying system utilizing a screw conveyor".

An example of drying means, which may be used with the embodiments of the present invention, may be found in U.S. Pat. No. 4,924,801, "Spray booth for lacquer".

Examples of lacquer bake ovens, which may be used with the embodiments of the present invention, may be found in U.S. Pat. No. 4,677,757, "Oven"; U.S. Pat. No. 4,610,898, "Process for bake coating the surfaces of solid substances"; and U.S. Pat. No. 4,243,778, "Thermosetting heat bondable lacquer".

Examples of dialysis circuits and membranes for use in same, which membranes and dialysis circuits may be utilized with the embodiments of the present invention, may be found in U.S. Pat. No. 4,192,748, 'Dialysis apparatus with selective chemical activity".

All, or substantially all, of the components and methods of the various embodiments may be used with at least one embodiment or all of the embodiments, if any, described herein.

All of the patents, patent applications, and publications recited herein, if any, are hereby incorporated by reference as if set forth in their entirety herein.

The details in the patents, patent applications, and publications may be considered to be incorporable, at applicant's option, into the claims during prosecution as further limitations in the claims to patentably distinguish any amended claims from any applied prior art.

The invention as described hereinabove in the context of the preferred embodiments is not to be taken as limited to all of the provided details thereof, since modifications and variations thereof may be made without departing from the spirit and scope of the invention.

What is claimed is:

1. A method for electrocoating an electrically conductive hollow body with a coating liquid to form a durable coating, wherein the hollow body has an internal surface, an external surface and an open end, said method comprising the steps of:

providing nozzle means for delivering coating liquid towards the hollow body;

supporting the hollow body in the vicinity of the nozzle means to permit delivery of coating liquid towards the hollow body such that:

a portion of the nozzle means faces the open end of the hollow body and the internal surface of the hollow body; and another portion of the nozzle means is disposed apart from the hollow body and the external surface of the hollow body;

applying a first voltage to the coating liquid and a second, different voltage to the hollow body to effect transport of coating liquid to the internal and external surfaces of the hollow body;

delivering coating liquid at least towards the internal surface of the hollow body for coating the internal surface of the hollow body;

simultaneously with said step of delivering coating liquid at least towards the internal surface of the hollow body, also delivering coating liquid at least towards the external surface of the hollow body for coating the external surface of the hollow body;

providing grate means for supporting the hollow body;

electrically connecting the grate means to an electrical source, the grate means being electrically conductive;

orienting the open end of the hollow body generally downward on the grate means;

transporting the hollow body along the grate means towards the nozzle means;

the coating liquid being delivered towards the hollow body in at least one generally ascending stream; and the coating liquid being delivered towards the hollow body through at least one opening of the grate means; and coating the hollow body with the coating liquid.

2. The method according to claim 1, wherein the hollow body is transported along the grate means in one of:

a generally continuous manner; and a generally stepwise manner.

3. The method according to claim 2, further comprising:

the grate means defining a plurality of openings.

4. The method according to claim 3, further comprising:

the coating liquid being delivered towards the hollow body to coat substantially the entire internal and external surfaces of the hollow body; and the internal and external surfaces of the hollow body being coated with a generally continuous layer of coating liquid.

5. The method according to claim 4, further comprising:

the coating liquid being delivered towards the hollow body to coat the entire internal and external surfaces of the hollow body; and the coating liquid being delivered towards the hollow body in at least one generally uninterrupted stream.

6. The method according to claim 5, wherein the coating liquid is delivered towards the hollow body solely in at least one generally ascending stream.

7. The method according to claim 6, further comprising the steps of:

transporting a plurality of hollow bodies along the grate means towards the nozzle means;

said step of transporting the plurality of hollow bodies comprising pushing the plurality of hollow bodies;

delivering the coating liquid towards the plurality of hollow bodies in at least one generally uninterrupted stream; and coating the plurality of hollow bodies with the coating liquid.

8. The method according to claim 7, further comprising:

the coating liquid being a lacquer;

the coating liquid being a water-soluble lacquer;

the internal surface of the hollow body defining an interior portion of the hollow body;

each of the at least one ascending stream of coating liquid defining a longitudinal axis;

housing means for housing coating liquid;

the nozzle means extending from the housing means for delivering coating liquid towards the hollow body;

the housing means comprising insulating material;

the nozzle means comprising insulating material;

means for applying the first voltage to the coating liquid and the second voltage to the hollow body;

the means for applying the first and second voltages comprising at least one electrode for providing electrical charge to the coating liquid, the at least one electrode being disposed in the housing means;

the first voltage being opposite the second voltage;

the hollow body being a can;

the hollow body being a beverage can;

a dialysis circuit at least through the housing means;

membrane means dividing the housing means into at least two chambers;

first coating liquid feed means for delivering coating liquid into the housing means;

a first of the chambers being connected to the first coating liquid feed means and the nozzle means;

the at least one electrode being disposed in a second of the chambers, the second chamber being disposed generally below the first chamber;

second coating liquid feed means being connected to the second chamber for delivering coating liquid into the second chamber;

coating liquid discharge means being connected to the second chamber for delivering coating liquid out from the second chamber;

screw conveyor means for transporting the hollow body along the grate means;

guiding means for guiding the hollow body during transport of the hollow body;

retention means for retaining the hollow body towards the grate means;

a catch basin being disposed underneath the housing means and the grate means, the catch basin being for collecting coating liquid;

the grate means and the hollow body for being anodic;

the housing means for being cathodic;

the nozzle means comprising between about 3 and about 5 nozzles;

the bars being separated by a plurality of spacer elements;

each of the bars having a lower base, the lower base having a horizontal dimension of between about $\frac{1}{2}$ inch and about $1\frac{1}{2}$ inches;

each of the bars having a vertical dimension measured between the lower base and the upper edge, the vertical dimension of each of the bars being between about 2 and about 6 inches;

the upper edge of each of the bars defining an angle of sharpness of between about 15 degrees and about 35 degrees;

each of the openings between the bars having a width of about 1 to about 3 inches;

each of the nozzles having a generally circular cross-section, the circular cross-section having a diameter of between about $\frac{1}{4}$ and about $\frac{3}{4}$ inches;

each of the nozzles having a vertical dimension defined between the housing means and the upper edges of the bars;

the vertical dimension of each of the nozzles being between about 3 and about 9 inches;

the housing means having a generally cylindrical shape;

the housing means having an upper portion and a lower portion, the first chamber being disposed within the upper portion and the second chamber being disposed within the lower portion;

the upper and lower portions defining the generally cylindrical shape;

each of the upper portion and the lower portion of the housing means having a flange portion;

the flange portion of the upper portion of the housing means being interfaced with and connected to the flange portion of the lower portion of the housing means;

the housing means having a wall thickness of between about 3/32 inch and 9/32 inch;

the generally cylindrical shape of the housing means having a radius of between about $\frac{7}{8}$ inch and about $2\frac{5}{8}$ inches;

each of the flanges having a thickness of between about $\frac{1}{8}$ and about $\frac{3}{8}$ inches;

the housing means having a substantially horizontal dimension, generally transverse to the bars, of between about $3\frac{3}{4}$ inches and $11\frac{1}{4}$ inches;

the flange portions of the housing means having a horizontal dimension, generally parallel to the bars, of between about 2 7/16 inches and about 7 5/16 inches;

the flange portions of the housing means having a horizontal dimension, generally transverse to the bars, of between about $4\frac{1}{2}$ inches and about $13\frac{1}{2}$ inches;

the first coating liquid feed means being tubular in shape and having a diameter of between about $\frac{3}{8}$ inch and about $1\frac{1}{8}$ inches;

the second coating liquid feed means being tubular in shape and having a diameter of between about 5/16 inch and about 15/16 inch;

the coating liquid discharge means being tubular in shape and having a diameter of between about $\frac{3}{8}$ inch and about 15/16 inch;

the means for applying the first and second voltages comprising a direct current source having two poles;

the bars being in electrical communication with one of the poles of the direct current source;

the electrode being in electrical communication with an opposite one of the poles of the direct current source;

the electrode being in electrical communication with a positive pole of the direct current source;

the bars being in electrical communication with a negative pole of the direct current source;

the second chamber of the housing means having an interior semicylindrical surface;

the electrode being disposed along the interior semicylindrical surface of the second chamber of the housing means;

the electrode having a thickness of between about $\frac{1}{8}$ inch and about $\frac{3}{8}$ inch;

the electrode having a length, transverse to the bars, of between about $3\frac{1}{4}$ inches and about $9\frac{3}{4}$ inches;

the electrode having a circumferential dimension being between about $\frac{1}{8}$ inch and about $\frac{3}{8}$ inches less than a circumferential extent of the second chamber of the housing means;

each of the nozzles comprising means for rotation each of the at least one ascending stream of coating liquid about its own longitudinal axis;

the screw conveyor comprising a shaft and a motor for driving the shaft;

the shaft of the screw conveyor having a pitch of between about $\frac{1}{2}$ inch and about $1\frac{1}{2}$ inches;

the shaft of the screw conveyor having a diameter of between about $\frac{1}{2}$ inch and about $1\frac{1}{2}$ inches;

said method further comprising:

causing each of the at least one ascending stream of coating liquid to rotate abut its own longitudinal axis;

at least one ascending stream of coating liquid being caused to rotate in a direction generally opposite that of an adjacent ascending stream of coating liquid;

the coating liquid being simultaneously delivered towards the internal surface of the hollow body through at least two of the nozzles such that the stream of coating liquid of at least one of the at least two nozzles rotates in a direction opposite that of an adjacent one of the at least two nozzles;

the coating liquid being delivered towards the hollow body such that at least one stream of coating liquid has a discharge pressure of about 1 bar;

said step of delivering the coating liquid towards the internal surface of the hollow body comprising substantially filling the interior portion of the hollow body with coating liquid;

executing said step of substantially filling the interior portion of the hollow body in about 15 milliseconds to about 20 milliseconds;

collecting coating liquid in the catch basin; and circulating the coating liquid at least through the housing means, the nozzle means and the catch basin.

9. The method according to claim 1, further comprising the steps of:

transporting a plurality of hollow bodies along the grate means towards the nozzle means;

said step of transporting the plurality of hollow bodies comprising pushing the plurality of hollow bodies;

delivering the coating liquid towards the plurality of hollow bodies in at least one generally uninterrupted stream; and coating the plurality of hollow bodies with the coating liquid.

10. The method according to claim 9, wherein the internal and external surfaces of the hollow body are coated with a generally continuous layer of coating liquid.

11. Apparatus for the electrocoating of an electrically conductive hollow body with a durable coating, wherein the hollow body has an internal surface, an external surface and an open end, said apparatus comprising:

housing means for housing coating liquid, the coating liquid for being applied to the internal and external surfaces of the hollow body;

nozzle means extending from said housing means for delivering coating liquid towards the hollow body;

means for supporting the hollow body in the vicinity of said nozzle means to permit delivery of coating liquid towards the hollow body;

means for applying a first voltage to the coating liquid and a second, different voltage to the hollow body to effect transport of coating liquid to the internal and external surfaces of the hollow body;

a portion of said nozzle means:

for facing the open end of the hollow body and being disposed apart from the open end of the hollow body; and for delivering coating liquid at least towards the internal surface of the hollow body for coating the internal surface of the hollow body; and another portion of said nozzle means;

for being disposed apart from the hollow body; and for simultaneously delivering coating liquid at least towards the external surface of the hollow body for coating the external surface of the hollow body;

said means for supporting the hollow body comprising grate means, the open end of the hollow body for being oriented generally downward on the grate means;

means for transporting the hollow body along the grate means towards the nozzle means;

said grate means being electrically conductive and for being connected to an electrical source;

said nozzle means being configured for delivering coating liquid towards the hollow body in at least one generally ascending stream; and said grate means comprising a plurality of openings, said nozzle means for delivering coating liquid towards the hollow body through at least one of said said openings.

12. The apparatus according to claim 11, wherein said grate means is for conveying electrical charge to the hollow body.

13. The apparatus according to claim 12, wherein said means for transporting said hollow body is for transporting the hollow body along the grate means in one of:

a generally continuous manner; and a generally stepwise manner.

14. The apparatus according to claim 13, wherein said nozzle means are configured for delivering coating liquid towards the hollow body solely in at least one ascending stream.

15. The apparatus according to claim 14, further comprising:

said means for transporting said hollow body along said grate means being for transporting a plurality of hollow bodies along said grate means, said plurality of hollow bodies for being coated with said coating liquid.

16. The apparatus according to claim 15, further comprising:

said grate means comprising a plurality of bars, said plurality of openings of said grate means being defined by said bars.

17. The apparatus according to claim 16, further comprising:

each of said bars having an upper portion for supporting the hollow body; and said nozzle means for discharging coating liquid in the vicinity of the upper portion of at least one of said bars.

18. The apparatus according to claim 17, further comprising a catch basin being disposed underneath said housing means and said grate means, said catch basin for collecting coating liquid.

19. The apparatus according to claim 18, further comprising means for circulating the coating liquid, at least a portion of said circulating means being formed by said housing means, said nozzle means, and said catch basin.

20. The apparatus according to claim 19, further comprising:

said housing means comprising insulating material;

said nozzle means comprising insulating material;

said means for applying said first and second voltages comprising at least one electrode for providing electrical charge to the coating liquid, said at least one electrode being disposed in said housing means;

said first voltage being opposite said second voltage;

the hollow body being a can;

the hollow body being a beverage can;

a dialysis circuit at least through said housing means;

membrane means dividing said housing means into at least two chambers;

first coating liquid feed means for delivering coating liquid into said housing means;

a first of said chambers being connected to said first coating liquid feed means and said nozzle means;

said at least one electrode being disposed in a second of said chambers, said second chamber being disposed generally below said first chamber;

second coating liquid feed means being connected to said second chamber for delivering coating liquid into said second chamber;

coating liquid discharge means being connected to said second chamber for delivering coating liquid out from said second chamber;

said nozzle means comprising a plurality of nozzles;

each of the at least one ascending stream of coating liquid defining a longitudinal axis;

each of said nozzles comprising means for rotating each of the at least one ascending stream of coating liquid about its own longitudinal axis;

at least one of said rotating means being for rotating at least one ascending stream of coating liquid in a direction generally opposite that of an adjacent ascending stream of coating liquid;

at least two of said nozzles being for simultaneously delivering coating liquid towards the internal surface of the hollow body such that the stream of coating liquid of at least one of said at least two nozzles rotates in a direction opposite that of an adjacent one of said at least two nozzles;

each of said rotating means comprising helix means;

at least one of said helix means being a left-handed helix;

at least one of said helix means being a right-handed helix;

at least one nozzle having a left-handed helix being disposed adjacent at least one nozzle having a right-handed helix;

at least one of said helix means being a cylindrical coil spring;

the upper portion of each of said bars of said grate means being defined by a single, generally sharp upper edge for supporting the hollow body;

said means for transporting the hollow body comprising screw conveyor means;

guiding means for guiding the hollow body during transport of the hollow body;

retention means for retaining the hollow body towards said grate means;

said coating liquid being a lacquer;

said coating liquid being a water-soluble lacquer;

said grate means and the hollow body for being cathodic;

said housing means for being anodic;

said nozzle means comprising between about 3 and about 5 nozzles;

said bars being separated by a plurality of spacer elements;

each of said bars having a lower base, said lower base having a horizontal dimension of between about $\frac{1}{2}$ inch and about $1\frac{1}{2}$ inches;

each of said bars having a vertical dimension measured between said lower base and said upper edge, the vertical dimension of each of said bars being between about 2 and about 6 inches;

said upper edge of each of said bars defining an angle of sharpness of between about 15 degrees and about 35 degrees;

each of said openings between said bars having a width of about 1 to about 3 inches;

each of said nozzles having a generally circular cross-section, the circular cross-section having a diameter of between about $\frac{1}{4}$ and about $\frac{3}{4}$ inches;

each of said nozzles having a vertical dimension defined between said housing means and said upper edges of said bars;

the vertical dimension of each of said nozzles being between about 3 and about 9 inches;

said housing means having a generally cylindrical shape;

said housing mean shaving an upper portion and a lower portion, said first chamber being disposed within said upper portion and said second chamber being disposed within said lower portion;

said upper and lower portions of said housing means defining the generally cylindrical shape;

each of said upper portion and said lower portion of said housing means having a flange portion;

said flange portion of said upper portion of said housing means being interfaced with and connected to said flange portion of said lower portion of said housing means;

said housing means having a wall thickness of between about 3/32 inch and 9.32 inch;

the generally cylindrical shape of said housing means having a radius of between about $\frac{7}{8}$ inch and about $2\frac{5}{8}$ inches;

each of said flanges having a thickness of between about $\frac{1}{8}$ and about $\frac{3}{8}$ inches;

said housing means having a substantially horizontal dimension, generally transverse to said bars, of between about $3\frac{3}{4}$ inches and $11\frac{1}{4}$ inches;

said flange portions of said housing means having a horizontal dimension, generally parallel to said bars, of between about 2 7/16 inches and about 7 5/16 inches;

said flange portions of said housing means having a horizontal dimension, generally transverse to said bars, of between about $4\frac{1}{2}$ inches and about $13\frac{1}{2}$ inches;

said first coating liquid feed means being tubular in shape and having a diameter of between about $\frac{3}{8}$ inch and about $1\frac{1}{2}$ inches;

said second coating liquid feed means being tubular in shape and having a diameter of between about 5/16 inch and about 15/16 inch;

said coating liquid discharge means being tubular in shape and having a diameter of between about $\frac{3}{8}$ inch and about 15/16 inch;

said means for applying said first and second voltages comprising a direct current source having two poles;

said bars being in electrical communication with one said pole of said direct current source;

said electrode being in electrical communication with an opposite said pole of said direct current source;

said electrode being in electrical communication with a negative pole of said direct current source;

said bars being in electrical communication with a positive pole of said direct current source;

said second chamber of said housing means having an interior semicylindrical surface;

said electrode being disposed along said interior semicylindrical surface of said second chamber of said housing means;

said electrode having a thickness of between about $\frac{1}{8}$ inch and about $\frac{3}{8}$ inch;

said electrode having a length, transverse to said bars, of between about $3\frac{1}{4}$ inches and about $9\frac{3}{4}$ inches;

said electrode having a circumferential dimension being between about $\frac{1}{8}$ inch an about $\frac{3}{8}$ inches less than a circumferential extent of said second chamber of said housing means;

each of said helix means having a vertical dimension of greater than about $\frac{1}{2}$ inch;

each of said helix means having a pitch of between about 1/16 and about 3/16 inches;

said screw conveyor comprising a shaft and a motor for driving said shaft;

said shaft of said screw conveyor having a pitch of between about $\frac{1}{2}$ inch an about $1\frac{1}{2}$ inches;

said shaft of said screw conveyor having a diameter of between about $\frac{1}{2}$ inch and about $1\frac{1}{2}$ inches; and said screw conveyor having a diameter of between about $\frac{1}{2}$ inch and about $1\frac{1}{2}$ inches.

* * * * *

UNITED STATES PATENT AND TRADEMARK OFFICE

CERTIFICATE OF CORRECTION

PATENT NO. : 5,164,056

DATED : November 17, 1992

INVENTOR(S) : Karsten LOECK

It is certified that error appears in the above-indentified patent and that said Letters Patent is hereby corrected as shown below:

In column 4, line 17, after 'and', delete the second occurrence of "5/16" and insert --15/16--.

In column 4, line 47, after 'about', delete "1/8 to 1 3/8" and insert --3/8 to 1 1/8--.

In column 7, line 30, after '5', delete "p".

In column 9, line 43, after 'Pat.', insert --No. 4,676,905, "Fluid separation method and apparatus"; and--.

In column 13, line 16, Claim 8, after 'for', delete "rotation" and insert --rotating--.

In column 13, line 27, Claim 8, after 'rotate', delete "abut" and insert --about--.

In column 16, line 60, Claim 20, after 'and', delete "9.32" and insert --9/32--.

UNITED STATES PATENT AND TRADEMARK OFFICE

CERTIFICATE OF CORRECTION

PATENT NO. : 5,164,056

DATED : November 17, 1992

INVENTOR(S) : Karsten Loeck

It is certified that error appears in the above-indentified patent and that said Letters Patent is hereby corrected as shown below:

Column 18, line 23, Claim 20, after 'inch', delete "an" and insert --and--

Signed and Sealed this

Third Day of May, 1994

Bruce Lehman

*Attest:*

BRUCE LEHMAN

*Attesting Officer*

*Commissioner of Patents and Trademarks*